United States Patent [19]

Kohl et al.

[11] Patent Number: 4,945,602

[45] Date of Patent: Aug. 7, 1990

[54] ADJUSTABLE FRAME AUTOMATIC FLOOR CLEANING MACHINE

[75] Inventors: Albert Kohl, Solothurn; Léon Seilaz, Koppigen, both of Switzerland

[73] Assignee: Henkel Kommanditgesellschaft auf Aktien, Duesseldorf, Fed. Rep. of Germany

[21] Appl. No.: 452,931

[22] Filed: Dec. 18, 1989

Related U.S. Application Data

[63] Continuation-in-part of Ser. No. 167,054, Mar. 11, 1988, abandoned.

[30] Foreign Application Priority Data

Mar. 13, 1987 [DE] Fed. Rep. of Germany ..... 3708087

[51] Int. Cl.[5] ..... A47L 11/202

[52] U.S. Cl. ..... 15/320; 15/328; 15/339; 15/353; 15/385

[58] Field of Search ..... 15/320, 321, 328, 339, 15/353, 383, 385

[56] References Cited

U.S. PATENT DOCUMENTS

| | | | |
|---|---|---|---|
| 1,601,087 | 9/1926 | Simpson | 15/328 X |
| 1,667,729 | 5/1928 | Fleming | 15/328 |
| 1,891,175 | 12/1932 | Petersen | 15/328 |
| 4,196,492 | 4/1980 | Johnson et al. | 15/320 |
| 4,207,649 | 6/1980 | Bates | 15/321 X |
| 4,429,433 | 2/1984 | Burgoon | 15/320 |
| 4,457,036 | 7/1984 | Carlson et al. | 15/320 X |
| 4,464,810 | 8/1984 | Karpanty | 15/320 |
| 4,741,069 | 5/1988 | Helm et al. | 15/320 |

FOREIGN PATENT DOCUMENTS

| | | | |
|---|---|---|---|
| 640004 | 7/1928 | France | 15/328 |

*Primary Examiner*—Chris K. Moore

*Attorney, Agent, or Firm*—Ernest G. Szoke; Wayne C. Jaeschke

[57] ABSTRACT

An improved drivable automatic floor cleaning machine includes a carriage supporting a fresh liquid compartment, a dirty liquid compartment, a cleaning rotor, a travel roller pair, and a rearward suction nozzle. The improvements include an adjustable machine frame with a depending protective curtain surrounding the periphery of the rotor remote from the suction nozzle, the machine frame being adjustable, preferably automatically, to accommodate rotors of different diameters, and to confine the cleaning liquid beneath the machine for improved efficiency and range of operation using either battery or rectifier power.

20 Claims, 6 Drawing Sheets

FIG. 1
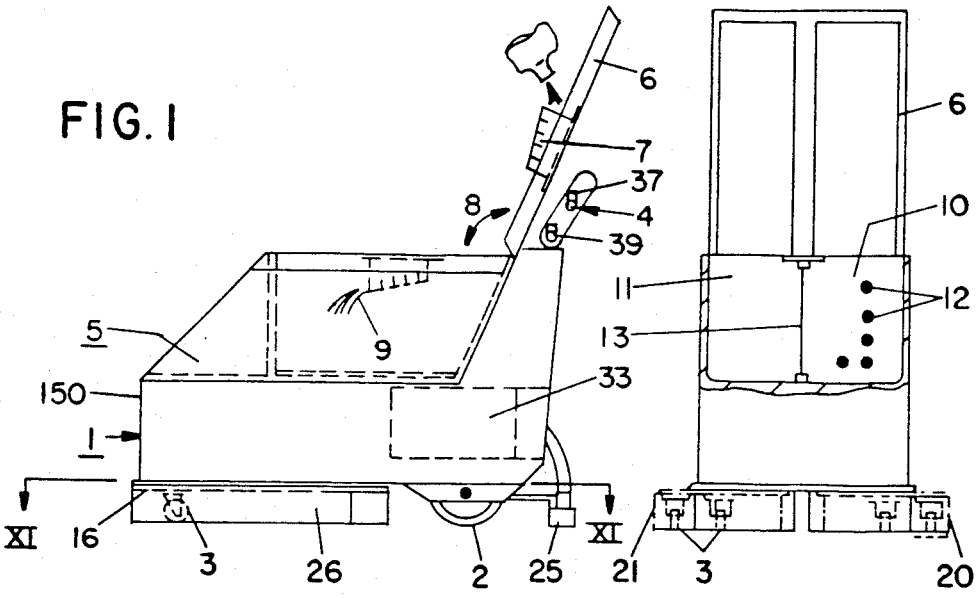
FIG. 3
FIG. 2
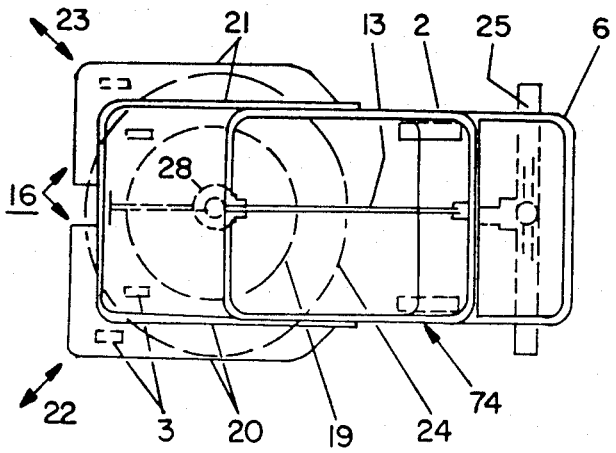

FIG. 4
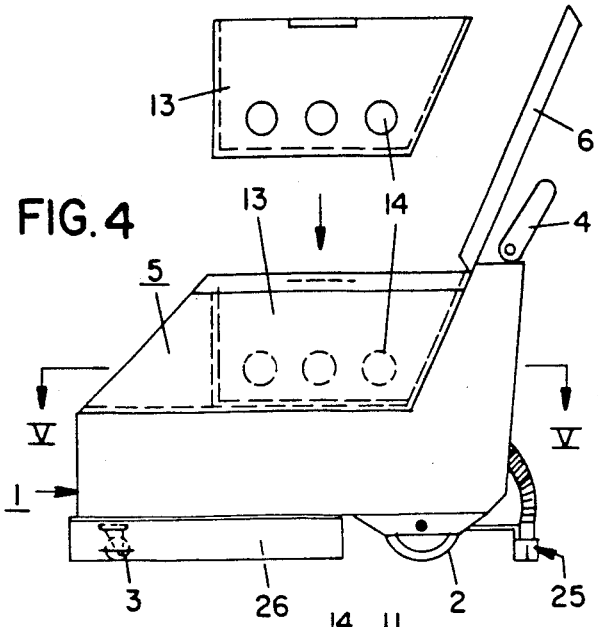
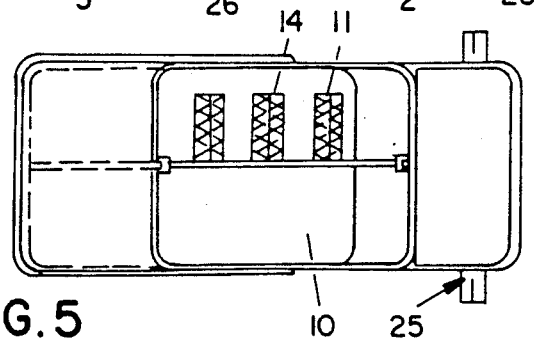
FIG. 5
FIG. 6
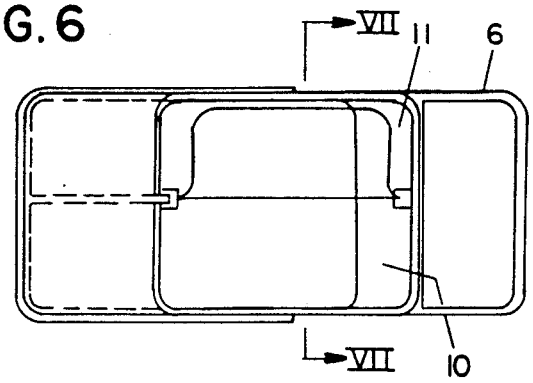
FIG. 7
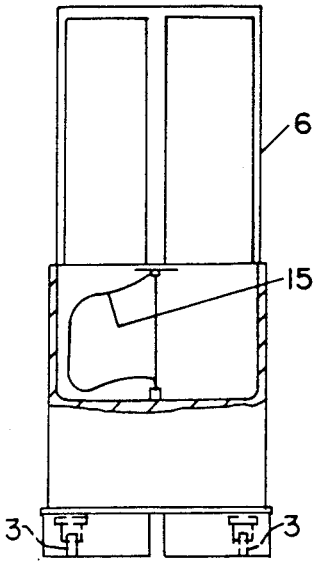

ADJUSTABLE FRAME AUTOMATIC FLOOR CLEANING MACHINE

RELATED APPLICATION

This application is a continuation-in-part of Ser. No. 07/167,054, filed on Mar. 11, 1988, and now abandoned, having the same title, inventorship, and assignee herewith.

BACKGROUND

1. Field of the Invention

The present invention relates generally to a drivable automatic floor cleaning machine having a carriage containing an integrated fresh liquid compartment and dirty liquid compartment, a cleaning rotor which is interchangeable without tools from the rotor receptacle, and is adapted to be supplied with cleaning solution from the fresh liquid compartment, at least one suction nozzle connected to the dirty liquid compartment for returning dirty water thereto from the surfaces being cleaned, a pair of travel rollers between the cleaning rotor and the suction nozzle, and a control handle containing operating control elements.

2. Discussion of Related Art

An automatic cleaning machine of this type, currently in use, has at its underside a rotor receptacle which is designed to be coupled with an accessory part, in particular a brush or a driven plate with pad, by laying the accessory part on the floor and driving the appliance over the accessory part or by placing the appliance thereon. Merely a brief starting of the motor associated with the rotor is then required to detent and fasten the accessory part.

In use, cleaning liquid mixed with cleaning concentrate is sprayed from a separate fresh water tank by way of the rotor onto the floor to be treated. At the same time, scrubbing is done with the aid of the rotor. A beam-like water suction nozzle, behind the rotor when the automatic machine is pushed forward, serves to suck up dirty water remaining after the scrubbing so that the floor can be scrubbed thoroughly and then wiped or vacuumed dry in a single operation.

The known automatic cleaning machine has electrical drives to be connected to the electrical power source directly by way of an electrical cable. In the case of long floors or large spaces, the electrical cable has to be replugged frequently. Also, completely separate tanks for fresh and used or dirty liquid are disposed in the housing of the automatic machine. Therefore, the combined tank volume can, on average be at most half used. Thus, the radius of action of the known automatic machine is restricted.

For the operation of the cleaning rotor of the known automatic machine, a relatively large volume of fresh liquid or usable water is needed because there is nothing to prevent the dispersed liquid from flowing in all directions over the floor surface being treated. A relatively large amount of energy is therefore needed to withdraw or suck up all of the liquid with the aid of the suction nozzle. Even powering such an automatic cleaning machine with a portable battery, independently of the main electrical power, will not substantially increase the radius of action because of the high amount of energy consumed during operation.

SUMMARY OF THE INVENTION

An object of the present invention is to improve automatic cleaning machines of the aforementioned type so that they can be supplied electrically from a portable battery, to provide a radius of action which is increased substantially compared with the cable operation.

It is another feature of the present invention to provide a convenient visual indication of the volume of liquid present within the fresh liquid compartment, and/or within the dirty liquid compartment, and/or to register these volumes as well as to facilitate the replenishment of the fresh liquid compartment with the respectively required cleaning agent concentration.

The present invention is primarily characterized by the provision of a machine frame which is adjustable to receive cleaning rotors of different diameters, and which has a depending protective circumferential curtain on a region of the frame remote from the suction nozzle. Also, the use of the protective curtain on three sides of the machine frame, surrounding the cleaning rotor, remote from the suction nozzle, confines the liquid sprayed or flowing into the region of the rotor substantially in the rotor working range of the floor, where it is required for scrubbing, and improves the suction performance of the water suction nozzle at the same time by the screening of the rotor side lying opposite the nozzle to a gap, which as a rule is very narrow, between the curtain and the floor. This increases the efficiency of the suction nozzle performance to provide a battery-driven automatic cleaning machine, which can treat very large surfaces without constant recharging or replenishment.

According to a further embodiment of the invention, the adjustable machine frame associated with the cleaning rotor comprises at least two frame parts, which are supported to be pushed apart or one into the other radially with respect to the rotor. The frame parts can, for example, each be connected with the other in the manner or a telescope. The adjustment itself can be carried out with the aid of a motor. In this manner, it is possible to restrict the space enclosed by the machine frame, with the protective curtain depending therefrom, largely to the volume taken up by the cleaning rotor. This matching of the volume of the cleaning space is not only advantageous in connection with the power take-up of the suction nozzle, but it also makes it possible, regardless of the rotor diameter, always to get the cleaning agent as far as the edge of the surface to be cleaned. Since there are as a rule only cleaning rotors of certain diameter groups, it is another embodiment of the present invention to provide a means to program the drive means for the widening or contracting of the machine frame so that the working space spanned by the machine frame can be automatically matched to the respective rotor diameter with the aid of a control, for example by pushbutton pressure, to be actuated from the control handle or the like of the automatic machine.

For a large radius of operation of the automatic cleaning machine, it is desirable to carry as much fresh liquid and dirty liquid as possible to reduce the need for refilling of the tank during the cleaning operation. Because of the appreciable weight connected therewith, it is a feature of the invention to provide at least one support roller apart from the travel roller pair arranged between the cleaning rotor and the suction nozzle, preferably a pair of support rollers, on the side of the cleaning rotor which lies opposite the pair of travel rollers, preferably still within the space spanned by the machine frame. This supports the automatic machine at all times, without any effort by the operating person, at the correct height for the cleaning rotor with respect to the floor to be cleaned. When the support roller(s) are fastened to the adjustable machine frame, they can be accommodated in the interior space between machine frame and rotor, because the support rollers in the case of enlarged rotor are driven together with the machine frame out of the range of rotation thereof.

In known automatic cleaning machines, the engaging an disengaging of the cleaning rotor requires tilting of the appliance about the axis of the travel rollers so that a rotor can be pushed under the appliance and under the respective coupling part, for example a conical entraining star, and lowering of the machine to push and couple or detent the rotor within the corresponding entraining receptacle. Because of the high weight of the entire machine supported on three or four wheels, a tilting of the appliance for the engaging or disengaging of an automatic cleaning rotor is difficult and dangerous. Therefore, it is preferable to provide a foot pedal to raise and lower the rotor receptacle of the machine, in particular with program control, for the engaging or disengaging of the cleaning rotor. For this purpose, the rotor receptacle preferably is controllable by way of coupling means, in particular with the aid of a separator motor, to be actuated from the control handle, fittings panel or the like.

Another feature or embodiment of the invention to provide a centering means for the centering of a cleaning rotor, which has been pushed under the appliance, with respect to the rotor receptacle at the adjustable machine frame. In spite of the high machine weight, it is then possible in a simple manner to engage or disengage a rotor in that the rotor receptacle of the appliance is raised or lowered automatically, and the rotor is simply pushed under the appliance by the foot and becomes centered for engagement.

For the sake of simplicity, the phrases "fresh or dirty liquid", and "fresh or dirty water" are used interchangeably herein. In order to have an adequate quantity of fresh water, or for cleaning and an adequate space for the reception of dirty water for disposal, even in the case of large surfaces to be cleaned, a container is provided which, according to a preferred embodiment of the invention, consists of a single total space which is subdivided by an intermediate wall into a fresh water compartment and a dirty water compartment. A solid intermediate wall can be provided, if desired, fastened in a position within the total space corresponding to the quantity ratio of fresh and dirty water finally to be expected, or the intermediate wall can be constructed to be flexible, such as a tight diaphragm or water sack.

In the latter case of a flexible intermediate wall, the total available space for the fresh water and dirty water can, in the course of the operation, automatically and gradually change due to displacement of the intermediate or separating wall from the fresh water compartment, which is dispensing fresh wagter, into the dirty water compartment, which is receiving dirty water. This has the further advantage that, after consumption of the fresh water, the fresh water side can be connected to a water duct for the purpose of filling the entire space with fresh water, expelling the dirty water automatically from the appliance (into a drain). Of course, the fresh water side and the dirty water side of the container optionally can each be equipped with an inflow hose and outflow hose, respectively, or the like.

In order to enlarge the radius of action of the automatic machine according to the invention, it is also possible to construct the intermediate flexible or rigid wall of filter material, or to equip it with filter cartridges. This enables a part of the dirty water to flow continuously through the filters back into the fresh water compartment; the usable consumed water volume is likewise increased substantially through this filtration and reuse.

It is also advantageous during the operation of the automatic machine according to the invention to know the quantity of fresh water available for use. For this purpose, according to a further embodiment of the invention, probes for the automatic detection of the volume of available fresh water are provided in the fresh water compartment of the tank. Preferably, these probes are supplied with alternating voltage by way of an integrated switching circuit (IC), which becomes conductive on immersion of the probes into the fresh water. The integrated circuit becomes conductive when, and for as long as, the respective probes are covered by liquid. In this case, the filling state can be visually indicated by luminescent diodes, pointer instruments, warning lights or the like.

To facilitate the replenishing of the fresh water supply with a metered amount of the cleaning concentrate to produce a solution of the desired strength, it is another feature of the invention to equip the fresh liquid compartment with a lid, pivotable through about 90°, which carries an integrated metering container for the cleaning concentrate. For example, the metering container can be constructed and preferably equipped with a volume scale so that the container, with the lid open, can receive the concentrate in measured manner in the desired quantity. Closing of the lid automatically empties the contents of the metering container into the fresh water compartment for admixture with the fresh water therein.

BRIEF DESCRIPTION OF THE DRAWINGS

Examples of various embodiments of the invention are described in detail below with reference to the accompanying drawings, in which like items are identified by the same reference designation, wherein:

FIG. 1 is a side elevation, partially in section, of a drivable automatic floor cleaning machine according to the present invention;

FIG. 2 is a projection of the automatic machine according to FIG. 1, illustrating two positions of the adjustable machine frame by means of broken lines;

FIG. 3 partially in section, is an elevation of the automatic machine of FIG. 1 from the left;

FIG. 4 is a side elevation, partially in section, of a drivable automatic floor cleaning machine according to an embodiment including an exchangeable, mechanically fixed intermediate wall;

FIG. 5 is a section along the line V—V of FIG. 4;

FIG. 6 is a section corresponding to FIG. 5 illustrating the embodiment of a flexible intermediate wall constructed as a diaphragm or water sack;

FIG. 7 is a section along the line VII—VII of FIG. 6;

FIG. 11 is a block circuit schematic diagram of one embodiment of the invention.

DETAILED DESCRIPTION OF THE INVENTION

Figure 8:
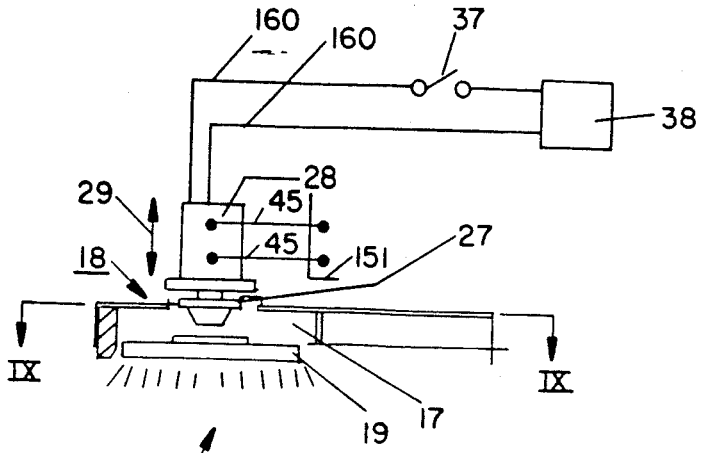
FIG. 8 illustrates the coupling region of an appliance entraining member and cleaning rotor according to an embodiment of the invention.

The FIGS. 1 to 3 show a drivable automatic floor cleaning machine in three different elevations, projections or sections. The automatic machine consists of a carriage generally designated as 1 with travel rollers 2 and support rollers 3 as well as a control handle 4 containing an operating panel. A large part of the interior of the carriage 1 comprises a liquid tank designated generally by 5 having a lid 6 with a metering container 7 supported thereon and displaying a scale. The scale preferably indicates the mixture ratio of fresh water to cleaning concentrate. With the lid 6 open, the metering container 7 can be filled according to the given mixture ratio. Through closure of the lid 6 in closing direction 8, the content 9 of the metering container 7 empties into the fresh liquid compartment of the liquid tank 5.

The liquid tank 5 consists of a fresh water compartment 10 and a dirty water compartment 11. In the illustrated embodiments, several spaced probes 12 are provided for the indication of different liquid levels in the fresh water compartment 10. The probes 12 can be acted on by an alternating voltage (direct current not being used in order to prevent a galvanic erosion of the probes) through an integrated switching circuit or IC 200. The IC 200 becomes conductive as soon as and for as long as the probes 12 are covered by an electrically conductive liquid such as water. The liquid levels can be indicated by luminescent diodes 202 and 204 for indicating low (LO) and high (HI) levels of liquid, respectively, pointer instruments, warning lights, or the like, connected to the difference probes 12 via IC 200.

The fresh water compartment 10 and the dirty water compartment 11 are separated each from the other by an intermediate wall 13. The intermediate wall can be a solid separating wall between both the compartments 10 and 11 as in FIG. 2 or 3. For adaptation to the respective quantity ratio, the wall 13 optionally can be displaceable or adjustable laterally for the separation of the compartments 10 and 11. A fixed intermediate wall 13 with filter cartridges 14 inserted therein is illustrated schematically in the FIGS. 4 and 5. In place of a fixed intermediate wall 13, a flexible intermediate wall 15 can be used, as shown by FIGS. 6 and 7, for the self-compensating separation of the fresh water compartment 10 from the dirty water compartment 11.

An important feature of the present drivable automatic floor cleaning machine is particularly clear from FIG. 2. According to FIGS. 1, 2, and 11, an adjustable machine frame 16 is fastened at the underside of the carriage 1 and comprises at least two frame parts 20 and 21, which are supported to be pushed apart and one into the other radially with respect to the cleaning rotor 19 engaged in a receptacle 18 on the underside 17 of the carriage 1. The frame parts 20 and 21 are thus displaceable radially towards and away from the receptacle 18 in the arrow directions 22 and 23, respectively, illustrated in FIG. 2. Through such an adjustment of the machine frame 16, it is possible to replace a rotor 19 of smaller diameter by a rotor 24 of larger diameter, and to match the machine space or washing space at least partially enclosed by the machine frame 16, in and around the cleaning rotor 19 or 24 as well as possible to the diameter of the installed rotor.

Figure 11:
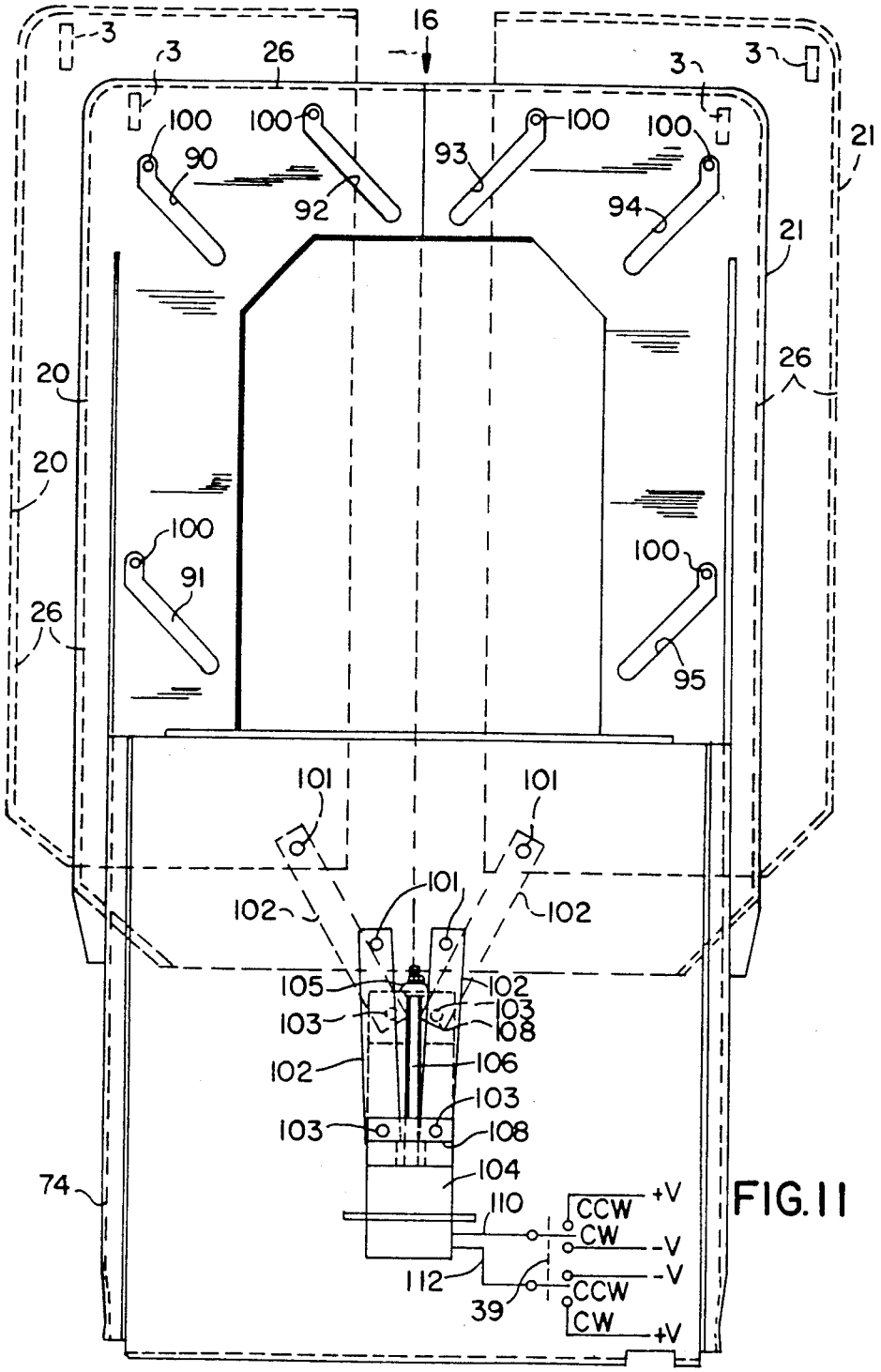
FIG. 11 is a sectional view along line XI—XI of FIG. 1 showing a top plan view of the radial extension mechanism of one embodiment of the invention.

With further reference to FIG. 11, the machine frame 16 also includes a central main portion 74 rigidly attached to the carriage 1. Frame parts 20 and 21 are movably supported over underlying fixed frame portion 74. Pivot pins 100 are rigidly connected to the underlying frame portion 74 and protrude through guide slots 90, 91, and 92 of movable frame part 20, and guide slots 93 through 95 of movable frame part 21. The support rollers 3 are rigidly mounted to the underside of the frame parts 20 and 21. A motor 104 is rigidly secured to frame part 74 by a standard mounting bracket (not shown) for positioning as shown. A threaded shaft 106 having one end connected to the motor 104, and another end rotatably secured to a bracket 105, the latter being rigidly secured to frame part 74 by a conventional bracket (not shown).

A threaded collar 108 is mounted for travel back and forth upon shaft 106. A pair of push rods 102 are pivotally mounted each at one end to threaded collar 108 via pivot pins 103. The other ends of push rods 102 are pivotally mounted via pivot pins 101 to frame parts 20 and 21, respectively.

In FIG. 11, the frame parts 20 and 21 are shown in their non-extended positions. To radially extend frame parts 20 and 21 to an extended position, a momentary two-position toggle switch 39 is operated to supply current in one direction to motor 104, for rotating shaft 106 in clockwise direction, for example, causing threaded collar 108 to move upward on shaft 106. In turn, the push rods 102 are moved upward via such movement of threaded collar 108, causing frame parts 20 and 21 to move radially outward. Provided switch 39 is held in the clockwise operative position, for applying $-V$ volts to one lead 110 and $+V$ volts to the other lead 112 of motor 104, for a sufficient period of time, frame parts 20 and 21 will reach their maximum extended positions, as shown in phantom. To retract frame parts 20 and 21, switch 39 is operated to its opposite operative position for reversing the current to motor 104 by reversing the polarity of voltage applied to motor leads 110 and 112, for in this example operating motor 104 to turn shaft 106 in a counterclockwise direction, for causing collar 108 to move downward, pulling push rods 102 downward, and in turn causing frame parts 20 and 21 to move radially inward about guide pins 100 within guide slots 90 through 95, respectively. Note that switch 39 is a momentary actuable double-pole-double-throw toggle switch, in this example. The mechanism shown in FIG. 11 for radially positioning frame parts 20 and 21 is shown for purposes of illustration, and not meant to be limiting. Other mechanisms such as hydraulic actuators, and so forth, could be substituted for portions of the mechanism illustrated.

At the rear side of the automatic machine, that is to say on the side of the travel rollers 2 remote from the cleaning rotor 19 or 24, a suction nozzle 25 is provided according to FIGS. 1 and 2 and can have the shape of a suction beam. On the front side of the automatic machine, thus opposite the suction nozzle 25 as well as at the sides of the automatic machine, that is to say laterally of the rotor, a curtain 26 is mounted depending from the machine frame 16 as illustrated by FIGS. 1 and 4. This structure substantially prevents water, at least in the case of a level even floor, from flowing beyond the sides of the machine screened by the machine frame 16 and curtain 26, respectively.

Figure 9:
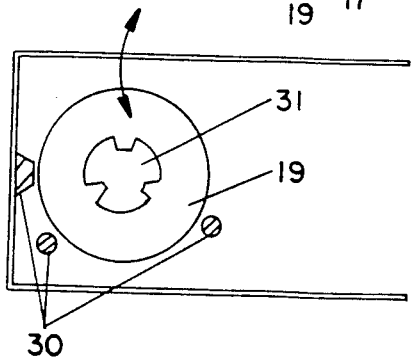
FIG. 9 is a section along the line IX—IX of FIG. 8.

An example of an embodiment of the rotor change system is described by reference to the FIGS. 8 and 9. For coupling a cleaning rotor 19, such as a rotary brush, into the receptacle, designated generally by 18, of the automatic machine, an entraining star 27 (with motor 28), provided as a coupling means, is initially raised in arrow direction 29. Thereupon, the rotor 19 is pushed under the machine until it abuts centering spigots 30 for preliminary centering, as illustrated in FIG. 9. Thereupon, the motor 28 is lowered in arrow directions 29 in such a manner that the entraining star 27 enters into the entraining receptacle 31 of the rotor 19 and detents there. Note that pivot arms 45 provide a parallelogram linkage between motor 28 and wall member 151.

For the ejection of a cleaning rotor 19 to be exchanged, the motor 28 is raised in arrow directions 29 and switched on briefly in such a manner that the rotor 19 drops off from the entraining star 27. After moving the machine away laterally, the rotor 19 can be taken out and, if desired, be replaced by another accessory part.

Figure 12:
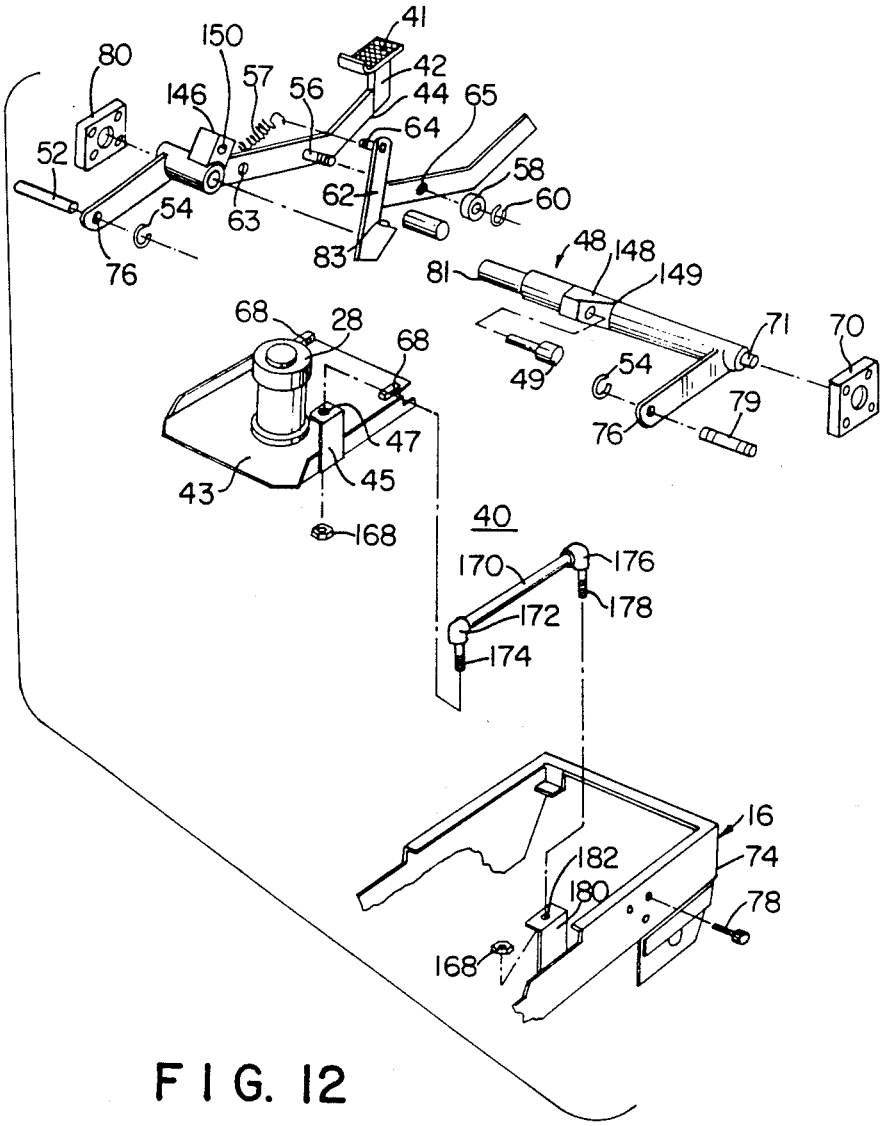
FIG. 12 is an exploded assembly view of a pedal mechanism for raising and lowering a rotor receptacle.
Figure 13:
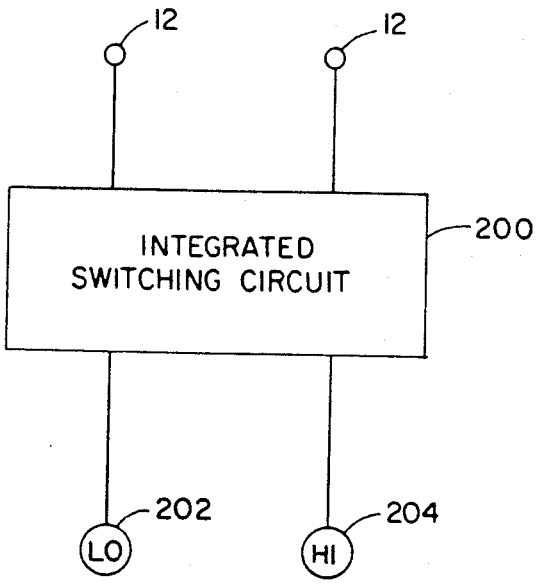

With reference to FIG. 12, a foot pedal mechanism for raising and lowering motor 28 and entraining star 27 includes, for example, as illustrated in a simplified exploded assembly diagram, a foot pedal 41 which is depressed for clockwise rotating a main shaft 48. Such rotation of shaft 48 lifts interconnecting arms 76, for raising one end of motor 28 and star 27. One opposite side of housing 43 includes a vertical mounting bracket 45 with a hole 47 through a flange thereof for receiving a threaded stud 174 of a linking arm 170, which is secured thereto via a nut 168. Another vertical mounting bracket 180 is rigidly secured to frame 16, as shown, for receiving through hole 182 a threaded stud 178 at the opposite end of linkage arm 170, which is secured thereto via another nut 168. Right angle swivel heads 172 and 176 connect the other ends of studs 174 and 178, respectively, to associated ends of linkage arm 170. The combination of linkage arms 170 and arms 76 provide a suspension parallelogram mechanism, including upper and lower parallel levers, respectively.

Foot pedal 41 is rigidly connected via a support arm 42 and pivot arm 44 to a pivot collar 46. Bearing plates 70 and 80 are secured via screws 78 to opposing sides of housing 74 of chassis 1. The bearing plates 70 and 80 receive opposite ends 71 and 81, respectively, of shaft 48. Also, a retaining pin 56 of pivot arm 44 provides for pivoting mounting of a locking arm extension 64 thereto. A washer 58 and "C" clamp or snap ring 60 are used to secure the latter to pin 56. A locking arm 62 is rigidly connected to one end of extension arm 64, and has at its upper end a spring support pin 65 for retaining one end of a spring 57. The other end of the spring 57 is secured via a pin 63 to an end of arm 44. A locking shaft 66 is secured by brackets (not shown) to the chassis 1 below and behind locking arm 62. Note that studs 146 and 148 of collar 46 and shaft 48, respectively, are locked or secured together via bolt 49 being pushed through the hole 149 in stud 148 into a threaded hole 150 of stud 146, into which it is threadably retained.

By depressing pedal 41 to almost an extreme downward position, conventional locking arm 62 will pivot via the spring bias of spring 57, to lock onto shaft 66 via protruding edge 83. In this manner, motor 28 and star 27 can be retained in a raised position, without further manual depression of pedal 41. To release locking arm 62 from shaft 66, the foot pedal 41 must be manually pushed downward, for permitting manual downward movement of the end of extension arm 64 to rotate locking arm 62 away from locking shaft 66, while allowing pedal 41 to raise upward. This results in the lowering of motor 28 and entraining star 27, to engage the rotor of a brush, for example. As the entraining star 27 is lowered, switch 37 (see FIGS. 3 and 8) is closed to energize the motor 28 to rotate entraining star 27 to insure it aligns with the mating hole in the rotor of the associated brush to be engaged. Note that switch 37 is a single-pole-single-throw switch for applying power source 38 (could be any one of power sources 32,34, or 36 of FIG. 10) to motor 28 via motor electrical leads 160.

With further reference to FIG. 12, adjustable mechanisms (not shown) can be included for adjusting the angle of the brush relative to the floor. The forward or backward tipping of the brush can be adjusted via such mechanisms, for providing adjustable control over the forward movement of the machine. Also, a screw adjustable tension spring mechanism (not shown) can be provided for spring biasing shaft 48 to adjust the brush pressure.

Figure 10:
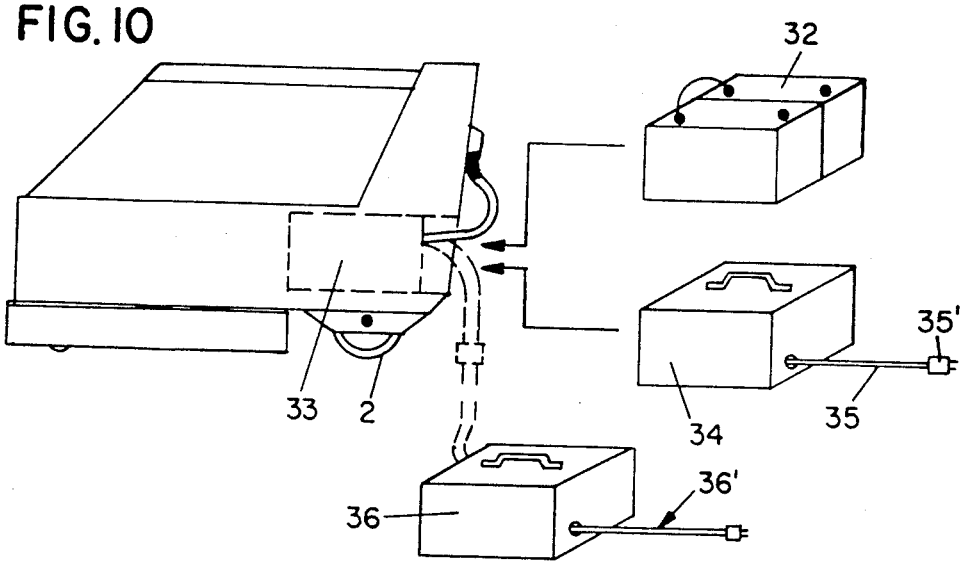
FIG. 10 illustrates a suitable electrical supply system for the drivable automatic floor cleaning machine of the invention.

The drivable automatic floor cleaning machine can, according to another embodiment of the invention, be powered selectably from a battery or directly from the mains. In case of battery operation, for example by 24 volts, FIG. 10 illustrates a set of batteries 32, ready wired, which are pushed into the battery compartment 33 of the machine, also shown in FIG. 1, and connected to the machine network. In case of mains operation (220 volts, alternating current), a mains part 34 containing a transformer and a rectifier is pushed into the battery compartment 33 and connected with the machine network. The mains part 34 possesses a connecting line 35 and plug 35' to plug into the nearest AC plug socket. The same mains part 34 can also be used externally of the machine as a charging device 36, including a line cord and plug 36', for the set of batteries 32 disposed in the battery compartment 33 of the machine.

It is to be understood that the above described embodiments of the invention are illustrative only and that modifications throughout may occur to those skilled in the art.

Accordingly, this invention is not to be regarded as limited to the embodiments disclosed herein, wherein such modifications are intended to be covered by the spirit and scope of the ammended claims.

What is claimed is:

1. In a drivable automatic floor cleaning machine, having a carriage containing a fresh liquid compartment and a dirty liquid compartment, a cleaning rotor removably attached to a rotor receptacle associated with the fresh liquid compartment for the supply of fresh liquid thereto, at least one suction nozzle connected to the dirty liquid compartment for the return of dirty liquid thereto, a travel roller pair positioned between the cleaning rotor and the suction nozzle and a control handle supporting operating control elements, the improvement which comprises an adjustable machine frame supported for radial movement relative to said rotor receptacle to accommodate cleaning rotors of different diameters, said machine frame having a depending protective curtain on a circumferential region thereof, remote from the suction nozzle, to substantially surround the cleaning rotor.

2. Automatic machine according to claim 1, in which said adjustable machine frame comprises at least two frame parts, which are supported for radial movement away from or into one another relative to the rotor receptacle.

3. Automatic machine according to claim 2 in which said frame parts are each connected with the other for telescoping movement, one into the other.

4. Automatic machine according to claim 1 which further comprises a motor for automatically adjusting the machine frame.

5. Automatic machine according to claim 4 in which said motor further comprises a foot pedal, for movement of the machine frame between at least two fixed positions.

6. Automatic machine according to claim 1 which further comprises at least one support roller or support roller pair mounted on the side of the cleaning rotor opposite the location of said travel roller pair.

7. Automatic machine according to claim 6 in which the support roller or the support roller pair is mounted on said adjustable machine frame.

8. Automatic machine according to claim 1 which further comprises a foot-actuated pedal associated with the rotor receptacle for raising and lowering the rotor receptacle to facilitate the engaging and disengaging of the cleaning rotor.

9. Automatic machine according to claim 8 in which said rotor receptacle includes a coupling means actuatable from the control handle, preferably a motor-driven conical entraining star which is engageable within an entraining opening in the cleaning rotor.

10. Automatic machine according to claim 1 which further comprises centering means on said adjustable machine frame for the centering of said cleaning rotor with respect to said rotor receptacle.

11. Automatic machine according to claim 1 in which said fresh liquid compartment and said dirty liquid compartment comprise a unitary tank divided into said two compartments.

12. Automatic machine according to claim 11 in which said fresh liquid compartment and said dirty liquid compartment of said unitary tank are each separated from the other by an intermediate wall.

13. Automatic machine according to claim 12 in which said intermediate wall includes filter means mounted in openings through selected portions of said intermediate wall for filtering dirty liquid as it passes from the dirty liquid compartment to the fresh liquid compartment.

14. Automatic machine according to claim 12 in which said intermediate wall comprises a flexible diaphragm.

15. Automatic machine according to claim 1 which further comprises at least one electrical probe mounted within the fresh liquid compartment for automatically detecting and indicating the presence of at least one liquid level within said compartment.

16. Automatic machine according to claim 15 in which said at least one probe is supplied with alternating current from an integrated switching circuit which becomes conductive on immersion of said probe into the fresh liquid within said fresh liquid compartment.

17. Automatic machine according to claim 16 which further comprises visual indicating means, such as luminescent diodes, associated with said integrated switching circuit and each said probe to provide an automatic visual indication of the liquid level within the fresh liquid compartment.

18. Automatic machine according to claim 1 which further comprises a battery compartment within said housing designed to receive both a battery and a rectifier unit, depending upon the desired power source.

19. Automatic machine according to claim 1 in which said fresh liquid compartment further comprises a lid which is pivotable through about 90° and which supports an integrated metering container for cleaning concentrate, said metering container being positioned to receive the concentrate when the lid is in open position and to automatically discharge the concentrate into the fresh liquid compartment when the lid is pivoted to closed position.

20. Automatic machine according to claim 19 in which said metering container has a graduated scale to indicate a required level of cleaning concentrate to provide a desired mixing ratio of cleaning concentrate to fresh liquid.

* * * * *